United States Patent [19]

Gerry

[11] 4,019,615

[45] Apr. 26, 1977

[54] LOW INERTIA IMPACT PRINTING MEANS

[76] Inventor: Martin E. Gerry, 13452 Winthrope St., Santa Ana, Calif. 92705

[22] Filed: July 26, 1976

[21] Appl. No.: 708,587

Related U.S. Application Data

[62] Division of Ser. No. 578,216, May 16, 1975, Pat. No. 3,985,218.

[52] U.S. Cl. ..... 197/53; 101/93.19

[51] Int. Cl.[2] ..... B41J 1/24

[58] Field of Search ..... 197/18, 49, 53, 54; 101/93.17, 93.19, 93.29, 93.48; 178/34

[56] References Cited

UNITED STATES PATENTS

| | | | |
|---|---|---|---|
| 3,640,369 | 2/1972 | Rolph | 197/53 X |
| 3,842,960 | 10/1974 | Gerry | 197/53 |

FOREIGN PATENTS OR APPLICATIONS

| | | | |
|---|---|---|---|
| 1,561,261 | 2/1970 | Germany | 197/53 |

OTHER PUBLICATIONS

IBM Tech. Disc. Bulletin, J. H. Meier et al., Type Wheel Assembly, vol. 17, No. 5, Oct. 1974, p. 1316.

IBM Tech. Disc. Bulletin, W. D. Thorne, Hammerless Printer, vol. 17, No. 11, Apr. 1975, pp. 3381–3382.

*Primary Examiner*—Edgar S. Burr
*Assistant Examiner*—Paul T. Sewell

[57] ABSTRACT

In a print head, a print wheel comprising the combination of a disk, a plurality of permanently magnetized printing members bearing characters thereon, and electromagnet imparting translation to the printing members by magnetic interaction, and also providing capability of additional mechanical impact upon the printing members. The print wheel has the capability of providing means to create pulses for obtaining character selection. The wheel may be made of resilient material, preferably non-magnetic. This wheel is generally mounted on a shaft of a stepping motor, the start and stop action of the motor and character selection being controlled by logic circuits well known in the art. The motor and electromagnet are generally mounted in a movable carriage as used in a computer terminal typewriter.

7 Claims, 6 Drawing Figures

LOW INERTIA IMPACT PRINTING MEANS

CROSS REFERENCE TO PARENT CASE

This application is a division of copending application Ser. No. 578,216 filed May 16, 1975, now U.S. Pat. No. 3,985,218.

CROSS-REFERENCE TO ISSUED PATENT

U.S. Pat. No. 3,842,960 issued to the same inventive entity is incorporated by reference as though fully set forth herein, for the purpose of describing and/or referring to logic systems existing in this art for character selection and stepping motor control and for providing suitable background.

INVENTION BACKGROUND

This invention is in the field of impact print heads magnetically actuated, wherein the character bearing members are permanently magnetically magnetized, and the characters are electronically selected.

Print heads are normally part of a typewriter carriage, so that when the head is actuated and a character is selected and printed the carriage is advanced to the next position for imprinting the next character.

The prior art uses print heads that are generally massive and have high inertia moments thereby slowing down the printing speed.

Other disadvantages of the prior art is that it is not possible to read the last few characters printed due to the print means causing visual obstruction.

Also existing in the prior art is a mechanically actuated print wheel, the character elements of which are activated only by an armature of a solenoid striking them. This wheel is made of metal such as steel for obtaining resiliency and is substantially heavier than any of the wheels of the instant invention due to support needed for the character elements and hence the use of relatively thick metal. The result is a much slower print action due to greater built-in inertia moments. Such prior art wheel resembles a typical wagon wheel structure except that there is no outer rim present and the spokes of the wheel each have a character at their extremities. This wheel, its spokes or that portion bearing the character is not permanently magnetized and therefore has the disadvantage of not being magnetically impelled to print the character. Such wheel may be found in typewriters identified as Model HyType I licensed for fabrication by Diablo Systems, Inc. of Hayward, California to Lexitron Corporation and used in its typewriter system made under Model Videotype 92.

U.S. Pat. No. 3,842,960 issued to the same inventive entity, although overcoming some of the prior art disadvantages has print wheels which have magnetizable members radially positioned on the disk or in the flat cylinder retaining the print character bearing members, and these magnetizable members add a good deal of mass to the wheel slowing it down and making rapid stopping and starting of the stepping motor difficult. Additionally, the disk or flattened cylinder is so constructed so as to have the character face oriented orthogonally to the plane of the disk or flattened cylinder. This orientation, sets up the requirement for the magnetizable radial members to be large in size in order to hold the character bearing members when the disk is being rotated at high speed, since in these structures the character bearing members have to be rather massive.

INVENTION SUMMARY

It is therefore an objective of this system to provide a print wheel in a print head that would be structurally simple, light in weight with low moment of inertia, and have small magnetically impelled permanently magnetized members of light weight bearing characters that are oriented in the plane of the disk of the print wheel for enabling simple and rapid character translation by magnetic repulsive action.

It is a further object to provide a wheel whose disk is made of substantially solid non-magnetic resilient material so as to enable a very thin wheel to be constructed to further decrease the moment of inertia, and to be so structured so as to also magnetically impell and translate a portion thereof bearing a character.

Accordingly, a print wheel is provided comprising a disk of solid resilient material, and a plurality of permanently magnetized members retained by the disk are circumferentially disposed about the disk periphery. Each of the members have a character integral therewith, the character being positioned in a plane substantially parallel to the plane of the disk. The walls of the disk are made thin, particularly at the location of the character bearing members to reduce disk weight.

The disk has thin wires of magnetic material embedded therein or otherwise integral therewith.

All the members of the wheel bearing characters may be magnetically impelled and translated by virtue of a field set up by an electromagnet that magnetically repells the selected character bearing member.

Figure 3:
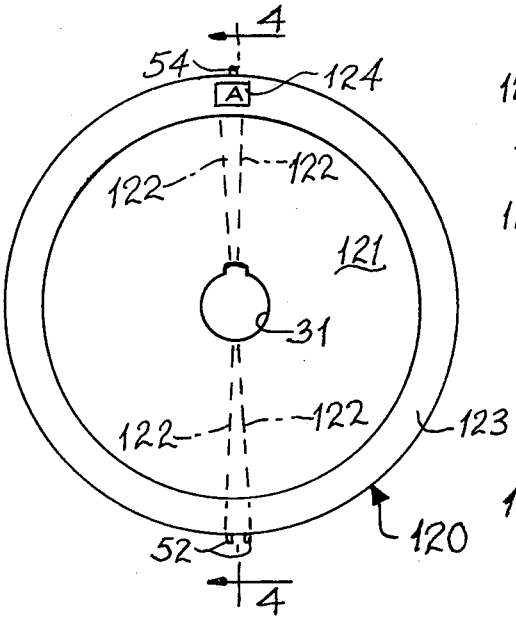
FIG. 3 is an elevation view of a wheel having a disk of non-magnetic or plastic material with magnetizable wires embedded in such material to magnetically hold the character bearing members.

FIG. **4*a* is a cross-section view taken at plane 4—4 of FIG. 3** showing a character bearing member recessed in the disk material and extending through an aperture of the material, the character bearing member being magnetically held by means of the embedded wires. An electromagnet is used to impell the character bearing members.

FIG. **4*b* is a cross-section view taken at plane 4—4 of FIG. 3** showing a character bearing member in the disk material, but that portion bearing the character is positioned in cooperation with the disk surface. Wires of magnetic material are embedded in the disk material to magnetically retain the character bearing member. An electromagnet is used to impell and translate the character bearing member.

Figure 4A:
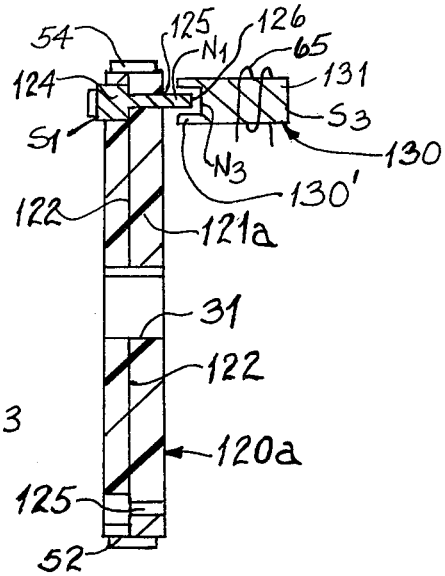
Figure 4B:
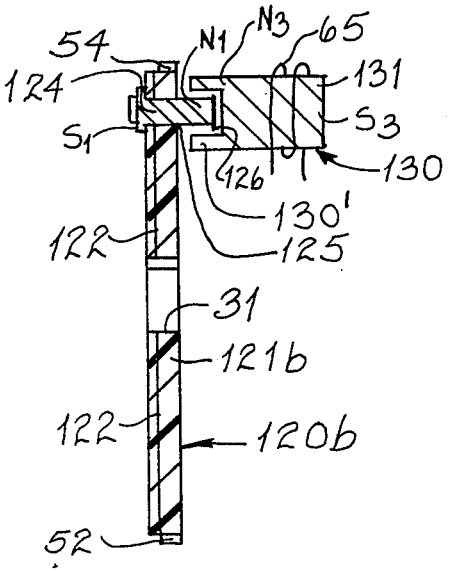

FIG. **4*c* is a cross-section view taken at plane 4—4 of FIG. 3 showing a wheel structure similar to that of FIG. 4*b*** but here the electromagnet additionally has provided a movable armature for mechanically as well as magnetically impelling the character bearing member.

DETAILED DESCRIPTION

Figure 1:
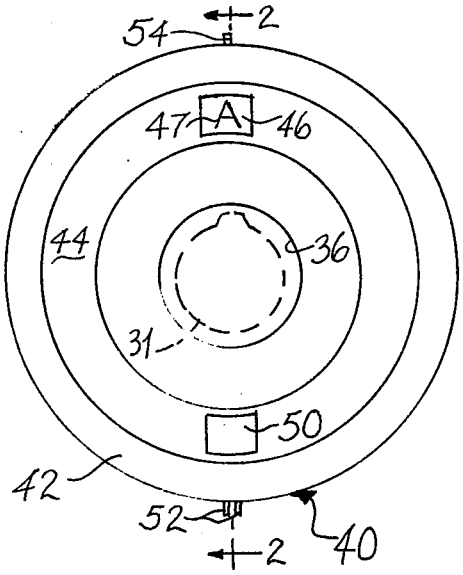
FIG. 1 is an elevation view of a character bearing wheel used to explain the invention.
Figure 2:
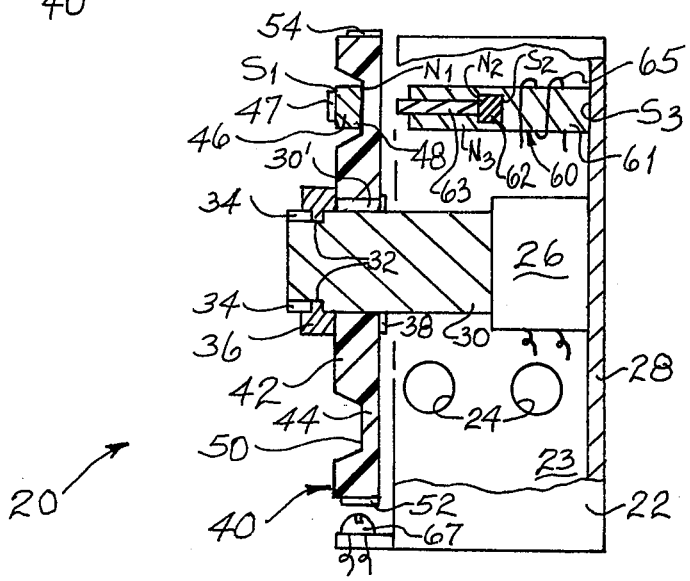
FIG. 2 is a view taken at plane 2—2 of FIG. 1 to show the character bearing wheel in cross-section, motive means for the wheel in elevation, electromagnet impact means in cross-section and magnetic sensor head in elevation, mounted in a typewriter carriage shown partly in elevation and partly in cross-section.

Referring to FIGS. 1 and 2, a print head is generally shown at 20. The control and operation of such print head has been discussed in the patent incorporated by reference herein to provide operability details of these types of print heads.

Such print heads used mostly in logic controlled typewriters as may be found in computer terminals, employs a carriage having sidewalls 22 and 23 and apertures 24 in both such sidewalls for mounting the carriage in slidable position on bars, not shown, which extend through these sidewalls and support the carriage; only apertures 24 in sidewall 23 have been shown inasmuch as sidewall 22 has been cut-away to display other components.

Stepping motor 26 provided herein and commonly used in this field of art, is mounted on rear wall 28 of the carriage. Shaft 30, driven by motor 26 when the head is in operation, has locking grooves 32 partially circumferential in shaft 30 and admitting grooves 34 for permitting tongues of lock nut 36 to be slid past admitting grooves into locking grooves 32. Rotation of lock nut 36 in a direction opposite to direction of shaft rotation will tighten the lock nut to retain a print wheel thereon.

Shaft 30 has an annular ring 38 integral therewith to act as a stop position for print wheel 40 having a notched central opening at 31 for sliding same on shaft 30 over keyed portion of shaft 30' corresponding to notch in opening 31, to cooperate with ring 38 and be locked in place by lock nut 36, thereby enabling the print wheel to be positioned in the same relative position on the shaft and also preventing the print wheel from slipping on the shaft surface when driven. In these figures as well as in other figures showing the print wheels, ring 38 and the peripheral surface within opening 31 may both be equally pitched at a slight angle so as to mount the print wheel where the plane of the disk therein is angularly displaced from the plane of the disk as shown in the drawings in order to enable the character bearing members to be impacted upon the platen of the typewriter with the characters tangential to the platen.

Print wheel 40 therefore generally comprises a disk of solid material as at 42 having thin wall 44 circumferentially of wheel 40 made of resilient material, generally of the same type of material as at 42, but this is not actually required since other and different materials may be used. Material for this type of use are generally resilient plastic or rubber, however, the material of wall 44 should be non-magnetic since a plurality of permanently magnetized members at 46 are attached by epoxy or molded to wall 44 at 48. Members 46 have characters such as illustrated at 47 on the face thereof, used to impact-print through a typewriter ribbon or the like on a paper sheet backed by a typewriter platen. Members 46 are permanently magnetized wherein the character face has been selected herein as the south magnetic pole $S_1$ and the junction of the thin wall and the member at 48 as the north magnetic pole $N_1$.

In these figures, it should be noted that print wheel 40 has a plurality of depressions in the wheel, or may have one continuous depression close to the disk circumference, in which permanently magnetized members 46 are affixed, except for one location as at 50 which has no character thereat. Location 50 is the zone in which counting of pulses begin, as discussed in the incorporated patent. Pulse start count for character selection is begun when a double magnetic marker 52 is sensed. All characters on the wheel, although only one character was shown for simplicity of illustration, have associated therewith a single magnetic marker as at 54, and character selection as referred to in the reference incorporated patent depends upon counting of pulses since each character has allocated to it a unique number of pulses.

Hence during operation of the print head, as wheel 40 is driven by shaft 30 when motor 26 is energized by a pulse source, and a character has been selected by depressing a particular typewriter key, counting of pulses will commence by virtue of magnetic head at 67 sensing the double pulse due to marker 52 passing said head and the circuit logic will begin counting the pulses created by passing of markers 54 past the magnetic head and stop the motor at the proper character location when the assigned number of pulses for that character had been counted, and to momentarily energize an electromagnet as at 60 thereby providing a strong magnetic field due to the electromagnet being energized so as to create magnetic poles $N_3$ and $S_3$, respectively its north and south poles, thereby repelling member 46 and streching that part of the thin wall on which member 46 selected is positioned to translate member 46 rapidly so as to provide impact by character 47 against the typewriter platen.

Electromagnet 60 may also have an additional capability when its coil 65 is momentarily energized by the circuit logic referenced. Additional mechanical impact against the thin wall portion and member 46 may be provided by virtue of core 61 of electromagnet 60 having fixed internally therein a small permanent magnet 62, magnetically polarized north and south as shown at $N_2$ and $S_2$ respectively. In non-energized state of the electromagnet one end of translatable magnetizable armature 63 is held by and is magnetically biased by the field of magnet 62. But when the electromagnet is momentarily energized, the field represented by poles $N_3$ and $S_3$ at the respective ends of core 61, is substantially stronger than the field due to permanent magnet 62 and hence overcomes the effect of magnet 62 field to cause armature 63 to be translated from its retracted position in core 61 outward from the core against that portion of the thin wall to which selected member 46 is attached to additionally provide mechanical transfer energy upon member 46 in addition to the magnetic repulsion thereon as previously discussed, for more positive translation force acting upon the selected character bearing member.

The magnetic member selection and electromagnet activation being momentary, the current in coil 65 will be cut off, and upon completion of impact print action, member 46 will return to its normal position, armature 63 having returned to its normal position to be magnetically held by member 62, since the field defined by poles $N_3$ and $S_3$ having collapsed.

Translatable member 63 is optional inasmuch as the system could be designed to operate by creation of the field defined by poles $N_3$ and $S_3$ to overcome the permanent magnet field $N_1$ and $S_1$. In such case, neither permanent magnet 62 or movable member 63 would be required as part of electromagnet 60, and core 61 could be a bar of magnetizable material.

It should be noted that in all subsequent illustrations hereinafter discussed, the same print head 20 is employed but only a print wheel is illustrated and discussed. Also, it should be noted that in most instances the impacting means as at 60 or similar structure will not be discussed again wherever the same or similar structures of electromagnets are used, except for those electromagnets having special features not hereinabove discussed. Hence is will be understood that similar components including magnetic markers and sensor heads are utilized in the following to be discussed print wheels, and all such similar components discussed above and omitted in subsequent structures are incorporated therein by reference to FIGS. 1 and 2.

It should also be understood that in all illustration, only one character bearing member need be shown for simplicity of illustration, inasmuch as showing all typical characters would involve needlessly complex drawings without enhancing the disclosure constituting inventive subject matter.

Figure 4C:
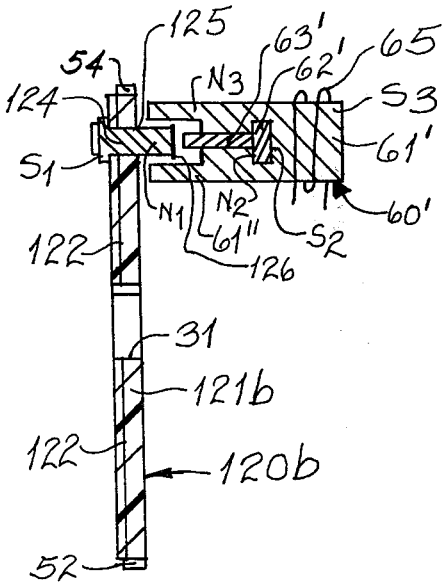

Referring to FIGS. 3, 4*a*, 4*b* and 4*c*, FIG. 4 is intended to represent the elevation view of the several print wheels shown in FIGS. 4*a* 4*b* and 4*c*. To avoid confusion, letters were used in association with the numerals of certain of the parts to show the variation, though slight, between FIGS. 4*a*, 4*b* and 4*c*.

Accordingly, print wheel 120 shows in cross-section disks 120*a* or 120*b*. These disks have a plurality of wires 122 of magnetizable material embedded in the solid non-magnetic or plastic material 121*a* or 121*b* of the disks, and radially positioned within this material. The disk material for all disks is generally shown in FIG. 3 as number 121. A plurality of apertures 125 are provided through the solid material of the disks in a direction orthogonal to the plane of the disk and spaced about its circumference at 123. Permanently magnetized members 124, each having characters at one end thereof, are magnetically held in apertures 125 by the embedded wires 122, being magnetically attracted to the magnetic material of these wires. Members 124, exhibiting south poles $S_1$ at the character bearing members near the character faces and north poles $N_1$ at ends opposite to the characters, will be repelled by the north poles created by an electromagnet as at 60′ or at 130. To prevent character bearing members 124 from accidentally being driven out of apertures 125 completely, the ends of these members may be peaned or otherwise enlarged as at 126.

The function of electromagnet 60′ or 130 is similar to that of electromagnet 60 discussed in connection with FIG. 2. However, here the cores as at 61′ and 131 respectively each have rectangular extensions 61″ and 130′ respectively. These rectangular extensions will assume magnetic poles $N_3$, as in the case of electromagnet 60 of FIG. 2, so as to repel the weaker magnetically polarized poles $N_1$ of the character bearing members during the energized modes of either of these electromagnets. Upon deenergizing of the electromagnets by removal of electrical power from coil 65, members 124 will be restored to normal by the prevailing magnetic bias due to the combination of wires 122 and members 124. Internal to core 61′ there will be present in fixed position a weak permanent magnet 62′ and a translatable armature 63′ held magnetically to magnet 62′ during the non-energized state of electromagnet 60′, so that upon energizing of electromagnet 60′ the weak poles of magnet 62′ will be overcome by the strong poles of electromagnet 60′ to enable armature 63′ to momentarily impact, mechanically, member 124. Electromagnet 130, however provides translation of member 124 by magnetic field action only.

Portions of members 124 extending through apertures 125, and apertures 125 are similarly shaped in rectangular, triangular or other keyed manner so as to inhibit rotation of these members in apertures 125. The non-magnetic disk material may also be made of TEFLON, which is polymerized tetrafluoro ethylene, or portions of members 124 extending through apertures 125 may be TEFLON coated, or apertures 125 may have a TEFLON circumference coating to assure smooth and frictionless translation of members 124. As in the case of the print wheel of FIGS. 1 and 2, magnetic markers 52 and 54 are provided as well as sensor head 67, not shown.

I claim:

1. A print head comprising the combination:

a disk of non-magnetic material having apertures through said material orthogonal to the plane of the disk spaced about the disk periphery;

a plurality of straight radially disposed magnetizable wires embedded in the non-magnetic material; and a plurality of elongated permanently magnetized fonts retained by said disk and disposed within said apertures, one of said fonts per one of said apertures, each of the fonts having an axis of elongation which is orthogonal to the plane of the disk, at least some of the fonts having characters integral therewith in a plane substantially parallel to the plane of the disk, said fonts being magnetically held in said apertures by said wires.

2. A print head comprising the combination:

a disk of non-magnetic material having a plurality of apertures through said material in a direction orthogonal to the plane of the disk spaced about the periphery of the disk;

a plurality of radially disposed magnetizable elongated members integral with the non-magnetic material:

a plurality of permanently magnetized fonts retained by said disk and disposed within said apertures, at least some of said fonts having characters integral therewith positioned in a plane substantially parallel to the plane of the disk, said fonts being magnetically held in said apertures by said members, said fonts being selectively translated along said direction during print mode of the head; and an electromagnet selectively magnetically coupled to said fonts during said print mode, said electromagnet having a magnetizable core with extensions for permitting portions of said fonts extending through said apertures to pass between said extensions when said disk is driven.

3. The invention as stated in claim 2, wherein said non-magnetic material is a plastic.

4. The invention as stated in claim 3, wherein said plastic is polymerized tetrafluoro ethelyne.

5. The invention as stated in claim 2, wherein each of the fonts have enlarged surfaces at their respective ends.

6. The invention as stated in claim 2, wherein that portion of any of said fonts extending through said apertures and said apertures are shaped so as to inhibit rotation of said fonts in said apertures.

7. The invention as stated in claim 2, wherein said magnetizable core includes a magnetizable armature and a permanent magnet biasing the armature in retracted position during non-energized state of said electromagnet.

* * * * *